US010030553B2

(12) United States Patent
Bach

(10) Patent No.: US 10,030,553 B2
(45) Date of Patent: Jul. 24, 2018

(54) ENGINE REVISION FOR PERISTALTIC OIL CHANGE

(71) Applicant: David T Bach, Bradenton, FL (US)

(72) Inventor: David T Bach, Bradenton, FL (US)

( * ) Notice: Subject to any disclaimer, the term of this patent is extended or adjusted under 35 U.S.C. 154(b) by 134 days.

(21) Appl. No.: 15/170,625

(22) Filed: Jun. 1, 2016

(65) Prior Publication Data

US 2017/0022858 A1 Jan. 26, 2017

Related U.S. Application Data

(60) Provisional application No. 62/169,064, filed on Jun. 1, 2015.

(51) Int. Cl.

| | |
|---|---|
| ***F01M 11/04*** | (2006.01) |
| ***F04B 43/12*** | (2006.01) |
| ***F04B 17/03*** | (2006.01) |
| ***F04B 49/06*** | (2006.01) |

(52) U.S. Cl.

CPC ..... *F01M 11/0458* (2013.01); *F01M 11/045* (2013.01); *F04B 17/03* (2013.01); *F04B 43/12* (2013.01); *F04B 49/06* (2013.01)

(58) Field of Classification Search

CPC ... F01M 11/0458; F01M 11/045; F04B 17/30; F04B 43/12; F04B 49/06

See application file for complete search history.

(56) References Cited

U.S. PATENT DOCUMENTS

| | | | | | |
|---|---|---|---|---|---|
| 3,033,311 | A * | 5/1962 | Edgar | F01M 11/045 | 184/1.5 |
| 3,095,062 | A * | 6/1963 | Neely | B67D 7/845 | 138/109 |
| 3,282,380 | A * | 11/1966 | Burrell | F01M 5/025 | 184/1.5 |
| 3,867,999 | A * | 2/1975 | Cox | F01M 11/0458 | 137/234.6 |
| 4,674,456 | A * | 6/1987 | Merritt | F01M 11/0458 | 123/196 R |
| 5,056,621 | A * | 10/1991 | Trevino | F01M 11/0458 | 123/196 R |
| 5,860,459 | A * | 1/1999 | Reed | F01M 11/045 | 141/192 |
| 6,073,666 | A * | 6/2000 | Clark, II | F01M 11/0458 | 141/65 |
| 6,779,633 | B2 * | 8/2004 | Viken | F01M 11/04 | 141/65 |
| 8,746,410 | B1 * | 6/2014 | Lekowicz | B63H 20/002 | 184/1.5 |

(Continued)

*Primary Examiner* — Michael A Riegelman
(74) *Attorney, Agent, or Firm* — Clifford H. Kraft

(57) ABSTRACT

A method and a kit for oil removal or injection into the oil pan of a vehicle, marine or aircraft engine. A modified dip stick tube extends to the bottom of the oil pan has at least one or more openings at its bottom end to allow oil to enter or exit. The top has an air-tight seal that can be attached to a flexible tube that can be run to a peristaltic pump. The pump can have an exit tube that runs into an oil recovery receptacle. After draining, the oil, the tube can be valved or physically relocated to a fresh oil source. The direction of rotation of the pump can be reversed to fill the oil pan with fresh oil. An electric control can run the pump in both a forward and reverse direction typically from a vehicle battery voltage source.

12 Claims, 5 Drawing Sheets

(56) References Cited

U.S. PATENT DOCUMENTS

| | | | | |
|---|---|---|---|---|
| 9,470,362 | B2 * | 10/2016 | Yao | F16N 13/00 |
| 2002/0023691 | A1 * | 2/2002 | Capstran | F01M 11/0458 141/98 |
| 2004/0065347 | A1 * | 4/2004 | Awad | B08B 9/0321 134/18 |
| 2013/0214184 | A1 * | 8/2013 | Miyazaki | F16K 7/00 251/4 |
| 2013/0287593 | A1 * | 10/2013 | Erwin | F04B 49/065 417/2 |
| 2016/0236657 | A1 * | 8/2016 | Erwin | B60S 5/00 |

* cited by examiner

ENGINE REVISION FOR PERISTALTIC OIL CHANGE

This application is related to, and claims priority from, U.S. Provisional Patent Application No. 62/169,064 filed Jun. 1, 2015. Application 62/169,064 is hereby incorporated by reference in its entirety.

BACKGROUND

Field of the Invention

The present invention relates to an engine modification that allows the dip stick tube to be used as a primary tube for oil removal and additions rather than inserting a tube into the engine through the dip stick tube.

Description of the Prior Art

Peristaltic pumps can be used to accomplish oil changes by removing and adding oil. These changes can be used for marine engines, in or out of the water, or can be used for land vehicle engines. The State of New Hampshire recommends that oil changes be performed using a dip stick removal as a way to protect the environment.

My provisional patent application 62/111,981 describes a method in completing a dip stick tube oil change. A FEP tube is inserted into the engine dip stick tube down to the bottom of the engine oil pan. Dip sticks, residing in the tube, have been used to allow the investigation of the color and level of the engine oil. It is the intention to show that the FEP tubing inserted into the dip stick tube can be replaced with a simple design change to the dip stick tube so that it can be used for oil changes.

SUMMARY OF THE INVENTION

The present invention provides a method and a kit wherein oil can be removed or injected into the oil pan of a vehicle, marine or aircraft engine. The invention requires a modified dip stick tube that extends to the bottom of the oil pan and has at least one or more openings or holes at its bottom end to allow oil to enter or exit the dip stick tube. The top of the modified dip stick tube has an air-tight seal that can be attached to a flexible tube. The flexible tube can then run to a peristaltic or other pump rotated by a pump motor. The pump can have an exit tube that runs into an oil recovery receptacle. After draining, the oil, the tube can be valved or physically relocated to a fresh oil source. The direction of rotation of the pump can be reversed to fill the oil pan with fresh oil. An electric control can run the pump in both a forward and reverse direction typically from a vehicle battery voltage source. The pump, pump motor, tubing, valves, cables, electric controller or switches and other accessories can be supplied in a water-tight toolbox housing as a field oil change unit. In an alternate embodiment, a shaft encoder or other shaft locating device can be used to inform the controller when enough oil has been pumped to properly fill the oil pan.

DESCRIPTION OF THE FIGURES

Attention is now directed at several figures that illustrate features of the present invention.

Several drawings and illustrations have been presented to aid in understanding the present invention. The scope of the present invention is not limited to what is shown in the figures.

Figure 5:
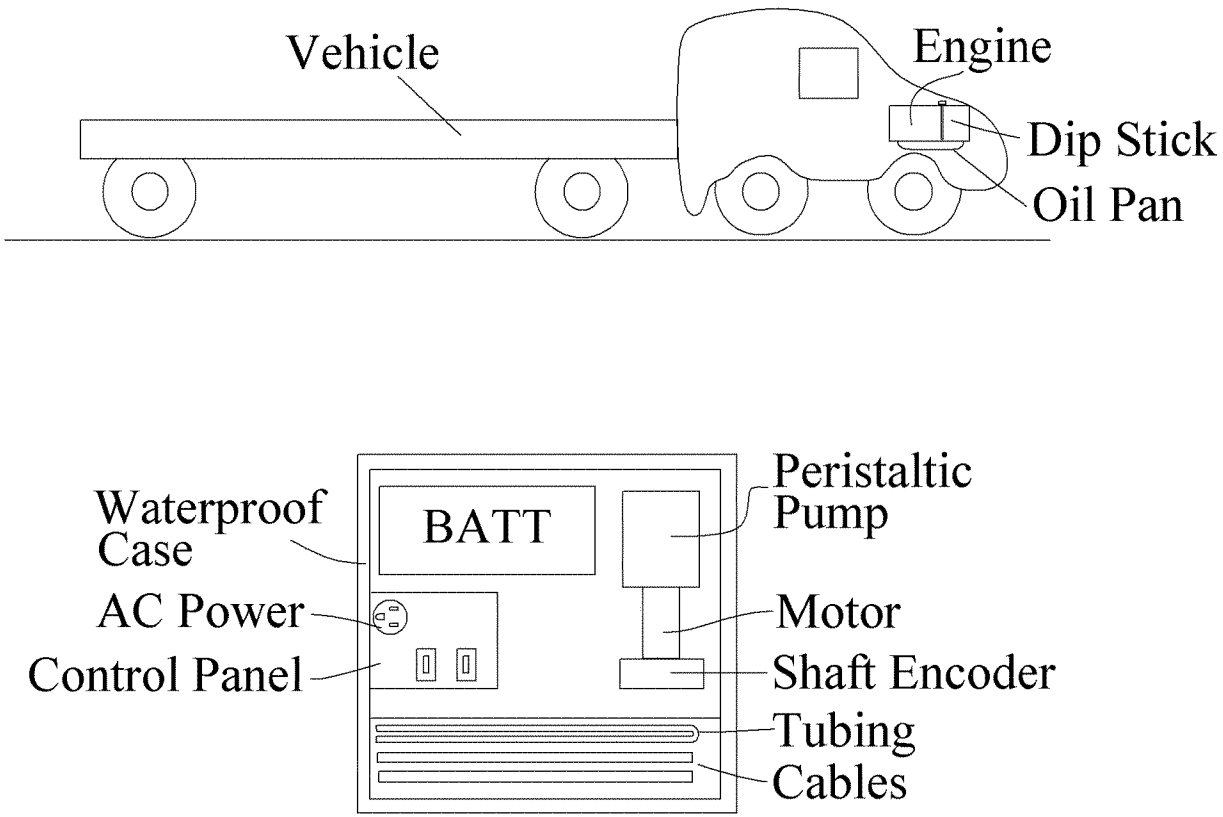

FIG. 5 shows an embodiment of the present invention in a waterproof case and shows a vehicle with an engine and oil dip stick.

DESCRIPTION OF THE PREFERRED EMBODIMENTS

Figure 1:
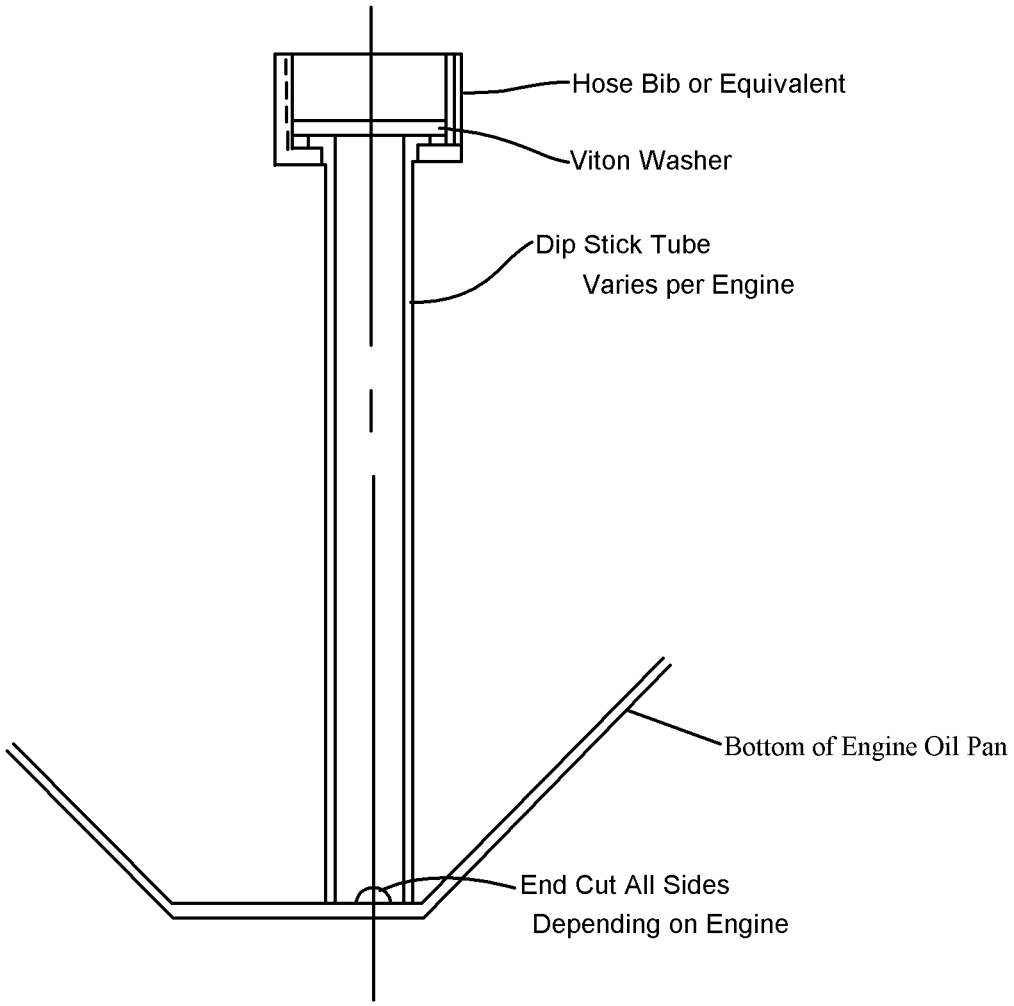
FIG. 1 shows design modification for a dip stick tube into the engine oil pan.

We have demonstrated the use of a Watson-Marlow 520R2, or other peristaltic pump, for oil changes. In the present invention, the peristaltic pump is used to remove oil from an engine using a special designed dip stick tube for the removal and addition of oil for an oil change. The design needs to have an air tight connection mechanism at the top surface of the dip stick tube. The dip stick tube extends to the bottom surface of the oil pan with the small cuts, holes or openings at the bottom end of the tube for allowing oil removal. Shown in FIG. 1 an embodiment of a design modification for a dip stick tube into the engine oil pan.

Figure 2:
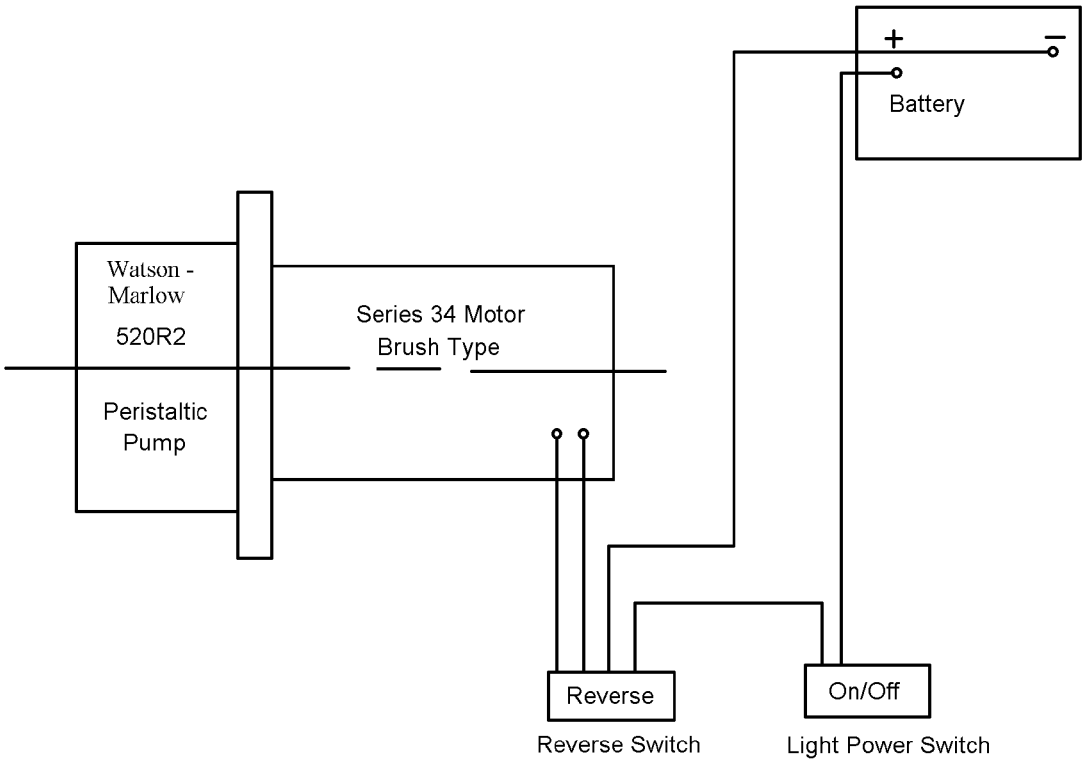
FIG. 2 shows the use of a 12 volt motor adequate to drive an 520R2 pump with the direction of the rotor movement reversible so that new oil can be inserted into the engine using the same tubing coupled to the engine dip stick tube.

The use of a 12 volt motor adequate to drive the 520R2 pump is required as shown in FIG. 2. Other voltages can be used, but the 12 volt battery makes this approach convenient. The motor can be a stepper, servo or brush or brushless type of motor that meets the requirement of operating the system with 9.6 mm internal diameter Viton tubing with 2.4 mm wall thickness. Other internal inside diameters, wall thickness and materials may be used. It is estimated that a series 34 motor can be used with the front shaft supporting the rotor assembly in the 520R2 housing. While, the system is preferably powered from the vehicle battery, any voltage source of any voltage can be used. In particular, the system can be made to operate on AC with a proper voltage control for the pump motor. A first Viton or other flexible tube is connected between the modified dip stick tube and the pump.

Figure 3:
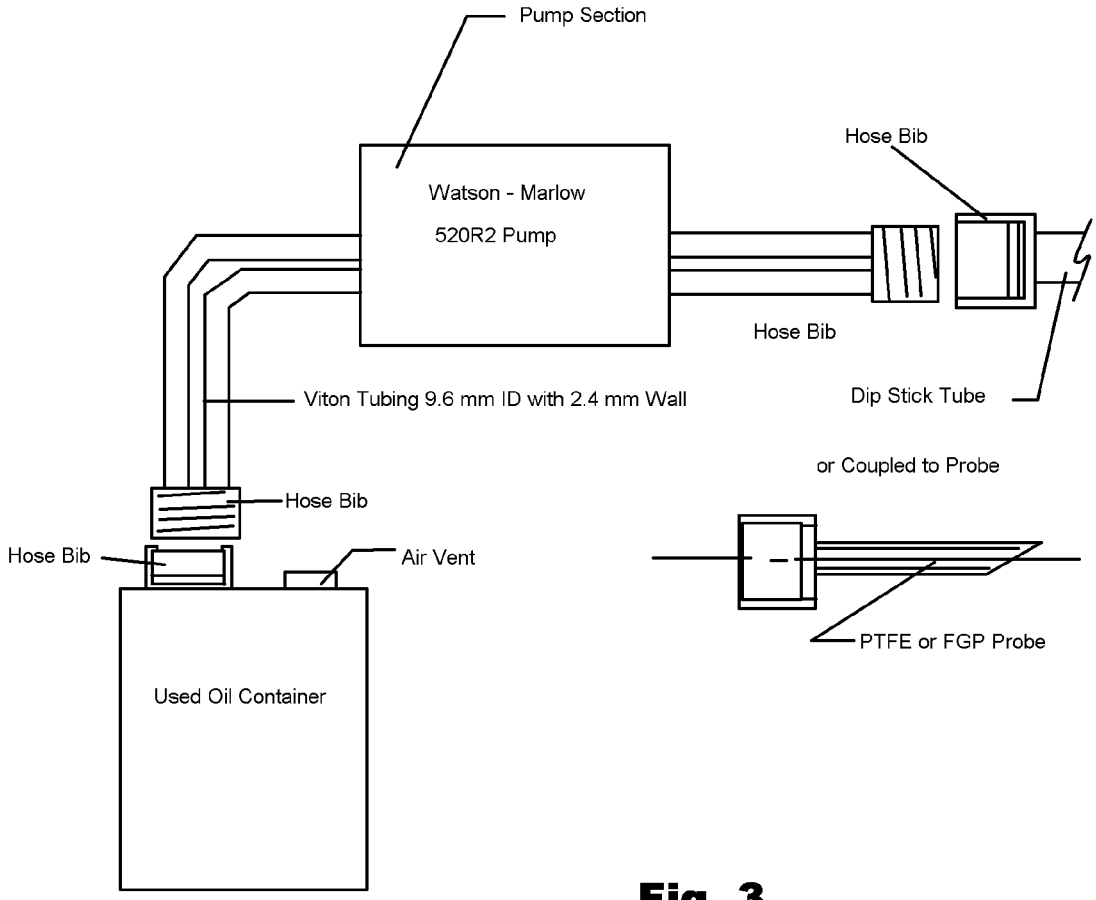
FIG. 3 shows tubing connectors.

The other end of the Viton flexible tube needs to couple to a used oil container or recovery reservoir. The coupling mechanism can also be used with a FEP probe or valve so that new engine oil can be inserted into the engine. The direction of the rotor movement is reversed so that new oil can be inserted into the engine using the same tubing coupled to the engine dip stick tube as shown in FIGS. 2-3.

The motor, pump, cables, switches and tubing can all be contained in a water-proof case as this system is designed for military and marine use. The pump motor can be operated with a formal control unit, or can simply be run with switches. Any type of motor controller is within the scope of the present invention. Other pump configurations and peristaltic pump compatible tubes can be used for engine oil changes that couple tubing to the top of a dip stick tube. The dip stick itself should be removed prior to making the oil change.

Prior to insertion of new oil into the engine, a new oil filter change should be made. Mating connector plugs can be used to prevent leaks if the tubing should be used again. The use of the term oil pan in this patent means any reservoir that holds oil in any type of vehicle, boat or aircraft.

Figure 4:
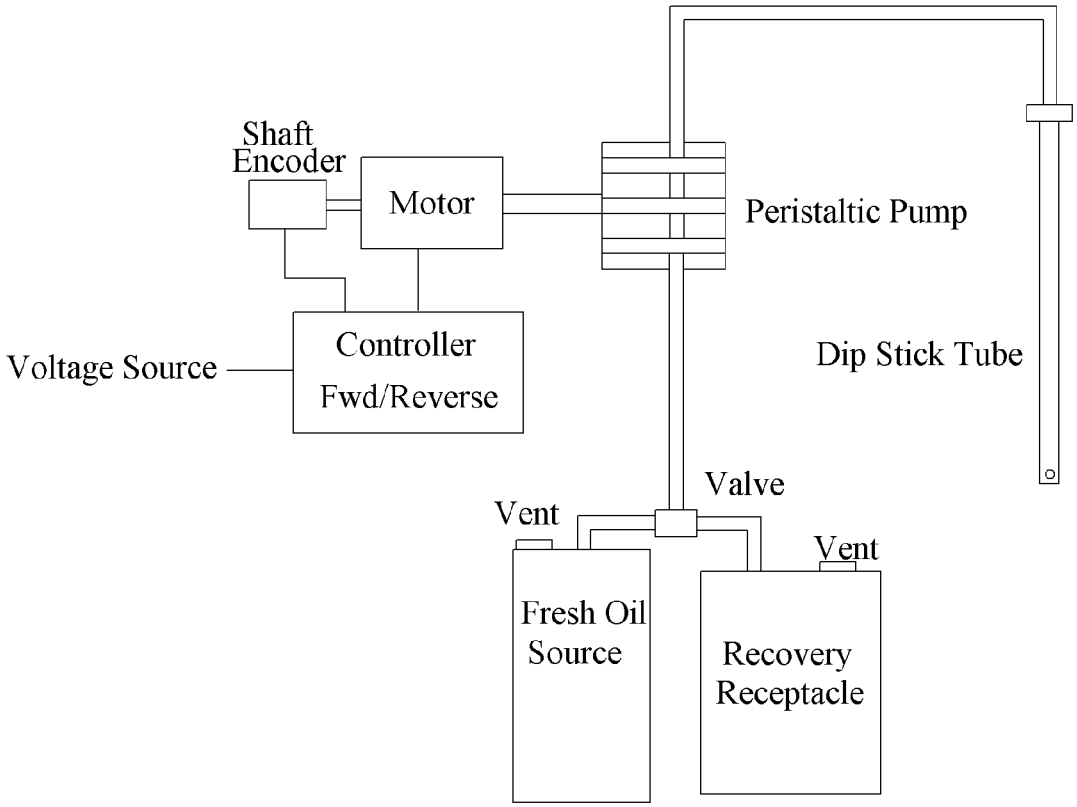
FIG. 4 shows a block diagram of an embodiment of the present invention.

FIG. 4 shows a block diagram of an embodiment of the present invention that uses a shaft encoder attached to the pump motor. The shaft encoder can signal the controller the exact shaft position and hence, the number of whole or partial revolutions. The controller can stop the pump in the fill mode when a predetermined number of whole or partial revolutions have occurred—the correct number for a proper fill of the oil pan. The controller can be pre-programmed for different sized pans on different vehicles, or it can be manually programmed before run time with the amount of oil desired to pump. For example, the controller might be programmed to deliver exactly 8 quarts of oil to the oil pan of a particular vehicle as specified in the owner's manual, or the controller can be preprogrammed for a particular model or type of vehicle, marine vessel or aircraft. In some embodiments, the controller can automatically change the valve from draining oil out of the engine to injecting oil into the engine.

FIG. 5 shows an embodiment of the present invention that includes a battery, control panel with reverse/forward switch and start switch as well as a peristaltic pump, cabling and tubing all contained in a waterproof case. FIG. 5 also shows a vehicle with an engine, oil pan and oil dip stick.

SUMMARY

The water-proof tool box of the present invention is carefully designed for the protection of the internal components:

Watson-Marlow 520R2 peristaltic pump, or other peristaltic pump;

Containment if oil should leak out of the Vition tube;

Battery cables long enough to couple the pump to the vehicle battery for electrical power;

Viton tubing that is used for coupling to the dip stick tube and used oil container;

Probe used to aspirate new oil back into the engine. This device should couple to the end of the Viton tubing coupled to the used oil container;

Necessary tools and manuals;

Power on/off switch;

Reversal switch;

Internal wiring and motor drive system.

In an alternate embodiment, the motor-pump arrangement can have a shaft encoder that sends shaft position information and notifies the controller of the number of whole or partial revolutions. In this manner, the controller can be pre-programmed to stop when a predetermined amount of fresh oil has been pumped into the oil pan.

In final summary, the present invention can be described as a method of facilitating removal or addition of oil for a boat or vehicle engine having an oil pan that includes the steps of modifying an existing vehicle dip stick tube to have an air-tight seal at a proximal end and to extend to the bottom of the oil pan, and to have at least one opening at a distal end, or providing to the vehicle a dip stick tube having an air-tight seal at a proximal end that extends to the bottom of the oil pan and at least one hole at a distal end;

providing at least: a peristaltic pump having a first port and a second port;

a first flexible tube adapted to mate with the air-tight seal on the dip stick tube at a first end and to connect to the first port of the peristaltic pump at a second end;

and a second flexible tube adapted to connect to the second port of the peristaltic pump at a first end, and to drain into an oil recovery receptacle at a second end;

In final summary, the present invention represents a method of facilitating removal or addition of oil for a boat or vehicle engine having an oil pan with the steps of:

modifying an existing vehicle dip stick tube to have an air-tight seal at a proximal end and to extend to the bottom of the oil pan, and to have at least one opening at a distal end, or providing to the vehicle a dip stick tube having an air-tight seal at a proximal end that extends to the bottom of the oil pan and at least one hole at a distal end;

providing at least: a peristaltic pump adapted to receive and pass through a flexible tube, the flexible tube adapted to mate with the air-tight seal on the dip stick tube at a first end, pass through the peristaltic pump, and run to an oil recovery receptacle at a second end;

providing a peristaltic pump motor mechanically coupled to the peristaltic pump adapted to rotate the peristaltic pump;

providing an electric control adapted to allow the peristaltic pump motor to be powered from a voltage source;

adapting the control unit so that it can run the peristaltic pump in both a forward and a reverse direction;

instructing a user to run the flexible tube through the peristaltic pump;

instructing the user to attach the first end of the flexible tube to the dip stick tube;

instructing the user to run the second end of the flexible tube into the oil recovery receptacle;

instructing the user to power the peristaltic pump from the voltage source through the control unit to pump oil from the oil pan into the recovery receptacle.

instructing the user to remove the second end of the flexible tube from the recovery receptacle after the oil pan is drained and to attach the second end of the flexible tube to a fresh oil source;

instructing the user to power the peristaltic pump in a reverse direction from the control unit to pump fresh oil into the oil pan until full.

Several descriptions and illustrations have been presented to aid in understanding the present invention. One with skill in the art will realize that numerous changes and variations may be made without departing from the spirit of the invention. Each of these changes and variations is within the scope of the present invention.

I claim:

1. A method of facilitating removal or addition of oil for a boat or vehicle engine having an oil pan, the oil pan having a bottom, comprising:

modifying an existing vehicle dip stick tube to have an air-tight seal at a proximal end and to extend to the bottom of the oil pan, and to have at least one hole at a distal end, or providing to the vehicle a dip stick tube having an air-tight seal at a proximal end that extends to the bottom of the oil pan and at least one opening at a distal end;

providing at least: a peristaltic pump adapted to receive and pass through a flexible tube, the flexible tube adapted to mate with the air-tight seal on the dip stick tube at a first end, pass through the peristaltic pump, and run to an oil recovery receptacle at a second end;

providing a peristaltic pump motor mechanically coupled to the peristaltic pump adapted to rotate the peristaltic pump;

providing an electric control adapted to allow the peristaltic pump motor to be powered from a voltage source;

running the flexible tube through the peristaltic pump;

attaching the first end of the flexible tube to the dip stick tube;

running the second end of the flexible tube into the oil recovery receptacle;

powering the peristaltic pump from the voltage source through the control unit to pump oil from the oil pan into the recovery receptacle;

adapting the control unit so that it can run the peristaltic pump in both a forward and a reverse direction;

instructing the user to remove the second end of the flexible tube from the recovery receptacle after the oil pan is drained and to attach the second end of the flexible tube to a fresh oil source;

instructing the user to power the peristaltic pump in the reverse direction from the control unit to pump fresh oil into the oil pan until full.

2. The method of claim 1 wherein the peristaltic pump is a Watson-Marlow 520R2 peristaltic pump.

3. The method of claim 1 wherein the flexible tube is Viton™ tubing.

4. The method of claim 1 wherein the flexible tube is attached to a selection valve adapted to choose between the oil recovery receptacle and the fresh oil source.

5. The method of claim 1 wherein the motor is chosen from the group consisting of: a stepper motor, servo motor and brush or brushless motor.

6. The method of claim 1 wherein the pump motor is an AC motor.

7. The method of claim 1 wherein the flexible tube has a 9.6 mm internal diameter and a 2.4 mm wall thickness.

8. The method of claim 1 wherein the pump motor, peristaltic pump, the electric control and flexible tube are all contained in a water-proof case.

9. The method of claim 1 wherein the voltage source is a vehicle battery.

10. The method of claim 1 wherein the voltage source is AC power line voltage.

11. The method of claim 1 further comprising providing a shaft encoder attached to the pump motor, the shaft encoder counting whole or partial revolutions and sending shaft position information to the electric controller allowing the electric controller to stop the peristaltic pump when sufficient fresh oil has been pumped into the oil pan.

12. A method of facilitating removal or addition of oil for a boat or vehicle engine having an oil pan, the oil pan having a bottom, comprising:

modifying an existing vehicle dip stick tube to have an air-tight seal at a proximal end and to extend to the bottom of the oil pan, and to have at least one opening at a distal end, or providing to the vehicle a dip stick tube having an airtight seal at a proximal end that extends to the bottom of the oil pan and at least one hole at a distal end;

providing at least: a peristaltic pump adapted to receive and pass through a flexible tube, the flexible tube adapted to mate with the air-tight seal on the dip stick tube at a first end, pass through the peristaltic pump, and run to an oil recovery receptacle at a second end;

providing a peristaltic pump motor mechanically coupled to the peristaltic pump adapted to rotate the peristaltic pump;

providing an electric control adapted to allow the peristaltic pump motor to be powered from a voltage source;

adapting the control unit so that it can run the peristaltic pump in both a forward and a reverse direction;

instructing a user to run the flexible tube through the peristaltic pump;

instructing the user to attach the first end of the flexible tube to the dip stick tube;

running the second end of the flexible tube into the oil recovery receptacle;

powering the peristaltic pump from the voltage source through the control unit to pump oil from the oil pan into the recovery receptacle;

removing the second end of the flexible tube from the recovery receptacle after the oil pan is drained and to attach the second end of the flexible tube to a fresh oil source;

powering the peristaltic pump in a reverse direction from the control unit to pump fresh oil into the oil pan until full.

* * * * *